United States Patent [19]

Denoor et al.

[11] 4,058,278

[45] Nov. 15, 1977

[54] APPARATUS FOR WINDING PLURAL STRIPS UNDER TENSION

[75] Inventors: Gaston Denoor; Georges Thillet, both of Grenoble, France

[73] Assignee: B.V.S., Grenoble, France

[21] Appl. No.: 667,436

[22] Filed: Mar. 16, 1976

[30] Foreign Application Priority Data

Nov. 5, 1975 France ..... 75.33750

[51] Int. Cl.[2] ..... B21F 17/00; B65H 77/00

[52] U.S. Cl. ..... 242/7.22; 57/10; 57/15

[58] Field of Search ..... 242/7.22, 7.21, 7.02, 242/2, 7.15; 57/10, 13, 15, 3; 156/425, 426

[56] References Cited

U.S. PATENT DOCUMENTS

| | | | |
|---|---|---|---|
| 2,749,054 | 6/1956 | Crom, Jr. | 242/7.22 |
| 2,921,427 | 1/1960 | Stark et al. | 57/15 |
| 3,572,596 | 3/1971 | Dykmans | 242/7.21 |
| 3,666,189 | 5/1972 | Dykmans | 242/7.21 |
| 3,727,390 | 4/1973 | Schwarz | 57/13 |
| 3,770,219 | 11/1973 | Hickman | 242/7.22 |

*Primary Examiner*—Billy S. Taylor

*Attorney, Agent, or Firm*—Haseltine, Lake & Waters

[57] ABSTRACT

Apparatus for winding at least one strip of an elongate product, such as a wire or ribbon, on to a cylindrical body from a spool of the product comprising means for producing relative rotation of the spool around the cylindrical body, a main drive unit for driving the rotation producing apparatus and connected to the axle of the spool through a differential driven by a secondary drive unit for braking the spool to tension said product. The secondary drive unit may be controlled by the output of a tension sensing mechanism sensing the tension of the product.

3 Claims, 6 Drawing Figures

FIG 1
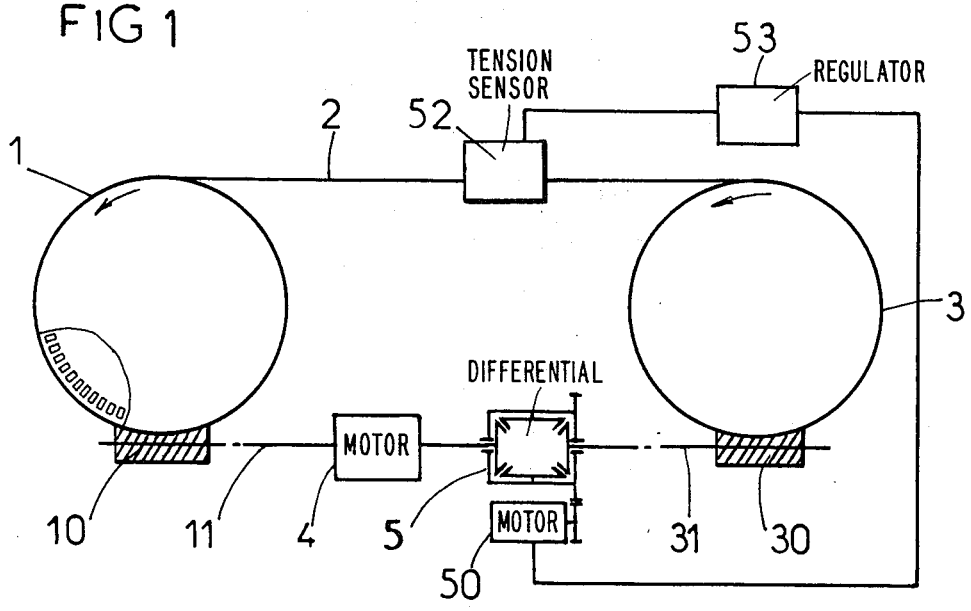
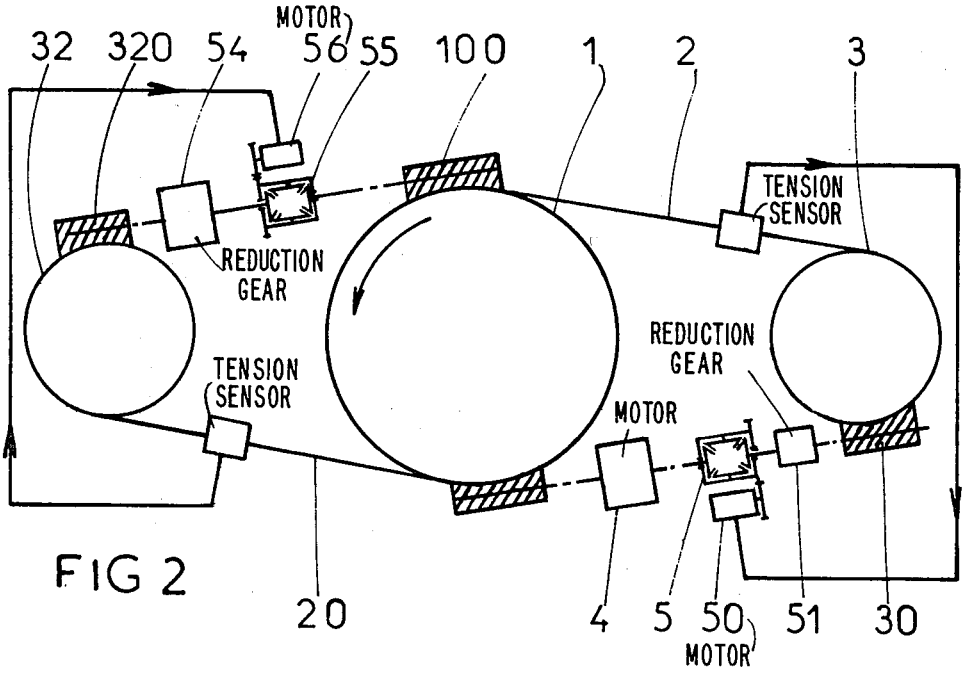
FIG 2

APPARATUS FOR WINDING PLURAL STRIPS UNDER TENSION

FIELD OF THE INVENTION

The invention relates to the winding of at least one strip of an elongate product under tension on to a cylindrical body from a spool holding a supply of the product.

BACKGROUND

Cylindrical bodies such as conduits or reservoirs which are subjected to internal pressure are often reinforced with strips of an elongate product, such as a wire, cable or ribbon, which are wound on to the bodies.

When the winding is effected under tension, a binding effect is achieved which enables the cylindrical body to be used at much higher internal pressures than the wall of the body could withstand by itself.

The binding can be done in rings, which may be contiguous or otherwise, each ring consisting of a plurality of superposed turns of the product wound around the tube with zero pitch, i.e. by several layers of the strip, e.g. metal ribbon, laid over one another and perhaps crossing over one another, each layer being would helically.

The elongate product is initially would on a supply spool, and, in order to apply it to the cylindrical body, the body may be rotated while the spool axis is fixed, or the spool may be rotated around the body, which is held fast. As the product is wound on to the body, it obviously unwinds from the spool, and to keep the strip under tension the unwinding of the spool must be braked.

It is important for the winding on to be carried out regularly, and especially important that the turns are at substantially the same tension. If not, after the tube is put into service there is a risk of the tension distributing itself among the windings, causing faults such as crossed wires. It is therefore useful to be able to control the tension in the product as it unwinds, to keep it at a substantially constant level.

When the unwinding of the spool is braked conventionally, by means of a braking member acting on the spool shaft, a disc brake, for example, it is difficult to control the tension, especially because of heating of the brake and because the braking torque varies with the diameter of the spool, i.e. with the amount of product left on the spool.

SUMMARY OF THE INVENTION

It is an object of the invention to provide apparatus for winding a strip on to a cylindrical body which enables the tension in the strip to be accurately controlled during winding.

In accordance with the invention, there is provided apparatus for winding at least one strip of an elongate product under tension on to a cylindrical body from a spool holding a supply of the product, comprising means for producing relative rotation of the spool around the cylindrical body, a main drive unit for driving said rotation producing means, and means for braking the unwinding of said spool, wherein said main motor unit simultaneously controls the unwinding of said spool by means of a differential driven by a secondary drive unit constituting said means for braking said spool.

When the cylindrical body is a relatively long conduit, it may be made up of tubes fastened end to end, and the binding can be effected tube by tube or continuously.

In our earlier French patent application No. 75 31448 there is described an apparatus by which a strip can be wound continuously on to a conduit without bending it. In this application, the tension in the strip is produced by braking the unwinding and is fairly low. In a preferred embodiment of the present invention a similar apparatus is provided in which several strips can be wound continuously on to a conduit but at relatively high tension and which enables the tensions in the strips to be controlled during winding.

BRIEF DESCRIPTION OF THE DRAWING

The invention will be more fully understood from the following description of embodiments thereof, given by way of example only, with reference to the accompanying drawings.

In the drawings:

FIG. 1 is a diagrammatic view showing the principle of an embodiment of operation of the invention;

FIG. 2 is a diagrammatic view showing the principle of operation of another embodiment of the invention;

DETAILED DESCRIPTION

Figure 3:
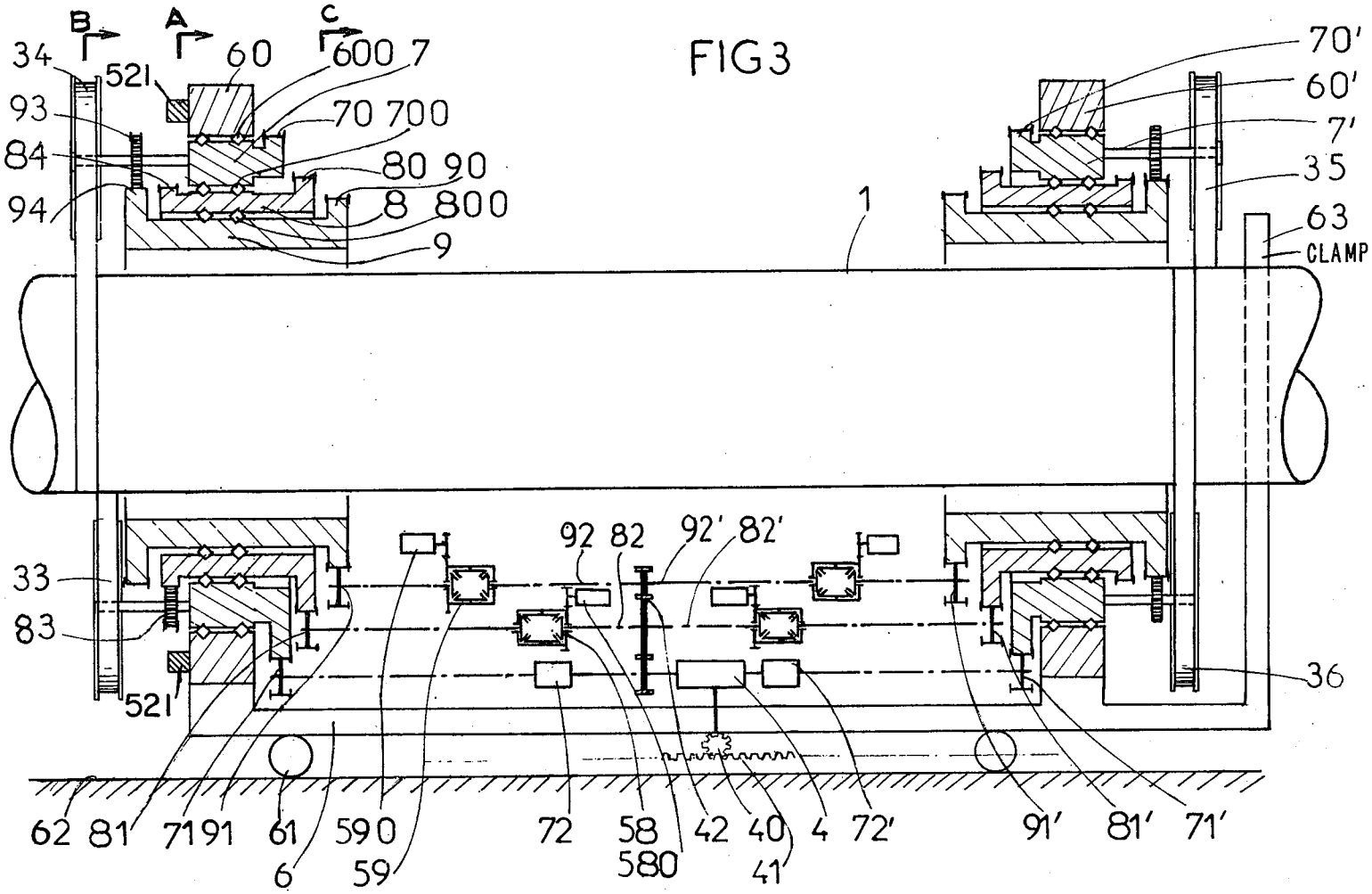
FIG. 3 is a longitudinal diagrammatic cross-section of apparatus according to the invention.

FIG. 1 shows a cylindrical body 1 on which a strip 2 in the form of a wire or ribbon is to be wound from above. The wire or ribbon 2 is unwound from a spool 3. As shown, the cylindrical body 1 and the spool 3 are driven about respective fixed axles by respective worm wheel drives 10 and 30.

The worm wheel drive 10 controlling the rotation of the cylindrical body 1 is driven by a main motor 4 which also drives the worm wheel drive 30 controlling the unwinding of the spool 3 through a differential 5 with planet wheels driven at a variable speed by a secondary motor 50. As shown in FIG. 1, the cylindrical body and the spool 3 have substantially the same diameter. The shafts 11 and 31 of the worm wheels 10 and 30 respectively are driven in directions such that the cylindrical body 1 and the spool 3 are driven in the same direction, shown in FIG. 1 by the arrows.

When the secondary motor 50 is stopped, operation of the main motor 4 causes the body 1 and the spool 3 to rotate at the same speed. If the initial tension in the wire or ribbon on the spool 3 is zero, it unwinds from the spool 3 to wind around the body 1 without tension, because the body 1 and the winding on the spool 3 are of the same diameter. If the secondary motor 50 is then caused to turn in the direction which makes the differential 5 decrease the unwinding speed of the spool relative to the speed of winding on the body 1, the wire 2 is stretched. The body 1 is then driving and the spool 3 driven. The power $P_1$ required to drive the body 1 is:

$$P_1 = T \times V$$

where $T$ is the tension in the wire and $V$ the winding speed.

The power $P_2$ provided at the shaft of the driven spool 3 is:

$$P_2 = T \times (V - v)$$

where $v$ is the reduction in speed of the driven spool 3 produced by the differential 5, by operation of the secondary motor 50.

The power $p$ provided by the motor 4 is:

$$p = P_1 - P_2 = T \times v$$

This power $p$ corresponds to the work required per unit time to stretch the wire elastically.

The power provided by the secondary motor 50 is equal to $-T \cdot v$.

If there were no friction, virtually no power would be required. The only power supplied, neglecting friction, is that for the tensioning. In practice, it is necessary to take into account the increase of the winding diameter of the cylindrical body 1 as the thickness increases due to the building up of successive layers, and also the corresponding decrease in the diameter of the spool 3 as it is emptied of the strip. The secondary motor 50 thus compensates for the stretching of the strip and the variations in diameter, through the intermediary of the differential 5.

When the cylindrical body and the spool have different diameters, as shown in FIG. 2, a reduction gear 51 is provided between the motor 4 and the worm drive 30 to reduce the power of the motor 50, to compensate for differences between the diameters of the cylindrical body and the spool so that the power from the motor 50 is only that theoretically required by the stretching of the strip and by the varying radii of strip wound on the body and the spool as the strip is wound from the spool on to the body.

The use of a secondary motor and a differential to control unwinding of the spool results not only in the tensioning of the wire, but also provides a very simple way of controlling the tension. To this end, an element 52 for sensing the tension is placed on the strip and controls the speed of the secondary motor 50, through a control circuit whose details will be clear to those skilled in the art, to keep the tension of the strip at the required value, to which the sensing element is set.

In its simplest form, as just described, the system operates as follows:

The end of the wire 2 is attached to the fixed cylindrical body 1 and the secondary motor 50 is started to provide the initial tension, the shaft 11 being locked. The wire 2 stretches elastically over a distance corresponding to the separation of the axes of the body 1 and spool 3 plus a length of arc stretched on the spool 3.

The main winding motor of the cylindrical body 1 is then slowly started. The tension control circuit controls the direction and speed of rotation of the secondary motor 50 to keep the tension at the required value. The motor 50 provides only that power corresponding to elastic deformation of the wire at the tension in question (braking power).

FIG. 2 shows an arrangement with two spools 3 and 32 arranged one on each side of the cylindrical body 1 so as to wind on the body 1 two wires at diametrically opposed points. This arrangement enables two layers of wire to be wound on to a very slender cylindrical body or tube without bending it, even with a high tension in the wire.

However, as shown, the unwinding of the second spool 32 is controlled by a worm drive 320 coupled via a reduction gear 54 and a differential 55 to a worm drive 100 driven by the cylindrical body 1. The main motor 4 thus simultaneously controls the winding of the wire on to the body 1 and the unwinding of the spools 3 and 32, the tension in the second wire 20 being controlled by a secondary motor 56 driving the differential 55 and whose direction and speed of rotation are determined by a control circuit similar to that described above for the motor 50.

The wires 2 and 20 are thus wound at the same tension, which is continuously controlled, and the result is a pure couple exerted on the body 1 with no resultant bending moment.

Figure 4:
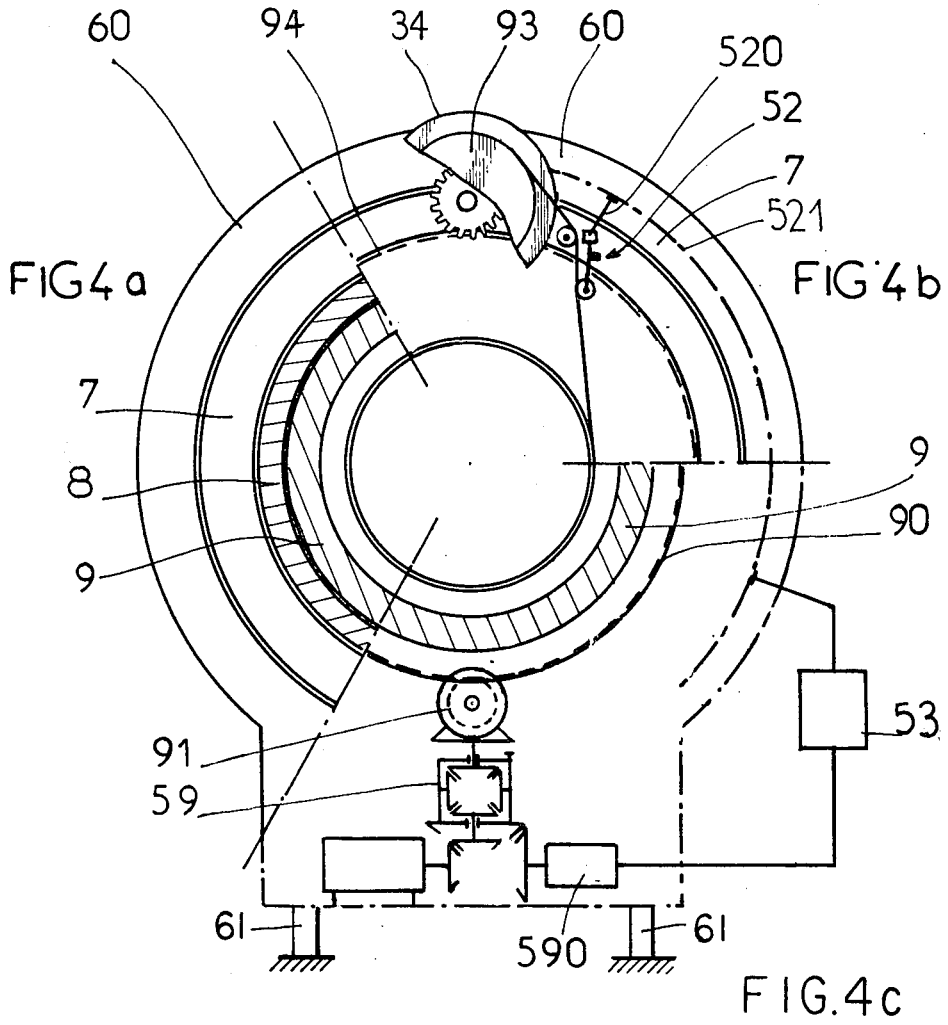
FIG. 4 shows three transverse cross-sections through different planes in the apparatus of FIG. 3, FIG. 4*a* being a section taken on line A, FIG. 4*b* being a section taken on line B, and FIG. 4*c* being a section taken on line C.

This type of machine continuously winds strips on to a long cylindrical conduit without risk of bending the conduit, the machine comprising two spaced turrets each carrying two spools of ribbon. FIGS. 3 and 4 show a machine of the same type, but adapted to the winding of a strip under tension in accordance with the present invention. The winding is carried out on a very long cylindrical conduit 1.

The machine comprises a frame 6 which is movable on rolling members 61 along rails 62 parallel to the longitudinal axis of the conduit. Movement of the machine is controlled by the main motor 4 via a kinematic system (not shown) driving a pinion 40 meshing with a rack 41 parallel to the rails 62.

The frame 6 is provided at its ends with two rings 60, 60' coaxial with the conduit and surrounding it with clearance. Each ring 60, 60' has on its inner face a rolling path formed by rollers 600 supporting a turret 7, 7' which can thus roll inside the ring 60, 60'. The axles of two spools 33 and 34 holding supplies of ribbon are attached to the turret 7 at diametrically opposed points and the axles of two other spools 35 and 36 are similarly fixed to the other turret 7'. Each of the turrets 7 and 7' is provided with a toothed ring 70, 70' meshing with a pinion 71, 71'.

The main motor 4 drives the pinions 71 and 71' in opposite directions through reduction gears 72 and 72'; as the two sets of windings are made in opposite directions and the ribbons are at the same tension, the resultant torque exerted on the machine is zero. Thus the winding of the ribbons on the conduit 1 is effected by rotating the spools around the conduit. In the earlier embodiment, the cylindrical body was rotated and the axes of the spools were fixed. It will be apparent that it is merely a matter of relative rotation so that the winding can be achieved just as well by rotating the spools around the fixed cylindrical body.

In this application, the tension in the ribbons may be great and is controlled using secondary motors and differentials as described above.

To this end, the inner face of the turret 7 is provided with a rolling path formed by rollers 700 on which rolls a turret 8 of smaller diameter. On the inner face of the turret 8 is a further rolling path formed by rollers 800 on which rolls a turret 9. There are thus three nested turrets rolling on one another inside each fixed ring 60.

As will now emerge, the rotations of the turrets can be independently controlled.

On the inner side, the turret 8 has a toothed ring 80 meshing with a pinion 81. The turret 9 is likewise provided with a toothed ring 90 meshing with a pinion 91. The pinions 81 and 91 are driven by respective shafts 82 and 92 through differentials 58 and 59, the planet wheels of the differentials 58 and 59 being driven by secondary motors 580 and 590. The shafts 82 and 92 are driven by the main motor 4 through a kinematic system 42.

Friction is negligible, and it will be seen that, because of the arrangement which has just been described, the motor 4 drives the turrets 7-8-9 separately around the longitudinal axis of the conduit, the secondary motors 580 and 590 controlling the rotational speeds of turrets 8 and 9 respectively, via the differentials 58 and 59.

The rings 8 and 9 control the rotation around their axes of spools 33 and 34 respectively. To this end, the turrets 8 and 9 are provided with respective toothed rings 84 and 94, normally on the outer side of the machine, meshing with respective pinions 83 and 93 keyed to the shafts of spools 33 and 34 respectively.

It will be seen that by judicious selection of the diameters of the toothed rings 80, 84, 90 and 94 and the pinions 81, 83, 91 and 93, and of the characteristics of the differentials 58 and 59 and the drive 42, the solution of an elementary problem of kinematics enable the speeds of unwinding the spools 33 and 34 to correspond to the speed of winding on to the conduit 1, the tension in the ribbons being controlled by operation of the secondary motors 580 and 590.

It will be appreciated that the spools 35 and 36 are controlled in an exactly similar manner to that of spools 33, 34, corresponding parts having the same reference numerals but with a prime.

It will be clear that the machine is shown in a very diagrammatic manner in FIG. 3, especially the rings 7, 8 and 9 fitted with toothed driving rings, so as to make the figures more intelligible. This applies particularly to the drive gears, the differentials, and the secondary motors; drawing showing the machine as they really are would be unacceptably complex.

FIG. 4 is also somewhat diagrammatic, and shows three partial transverse cross-sections on different planes. FIG. 4*a*, a section on the line A in FIG. 3, shows the arrangement of the ring 60 and the turrets 7, 8 and 9 nested inside one another; FIG. 4*b*, a section on the line B in FIG. 3, shows the driving mechanism 94, 93 of the spool 33; FIG. 4*c*, a section on the line C in FIG. 3, shows the drive mechanism 90, 91 of the turret 9.

It will be appreciated that the control of the tension of the wound ribbon is of particular importance in the case of a machine as shown in FIG. 3 which winds four ribbons at once, since it is the arrangement of the ribbons and the equality of the tensions in them which guarantees the absence of bending moments on the conduit.

Figure 5:
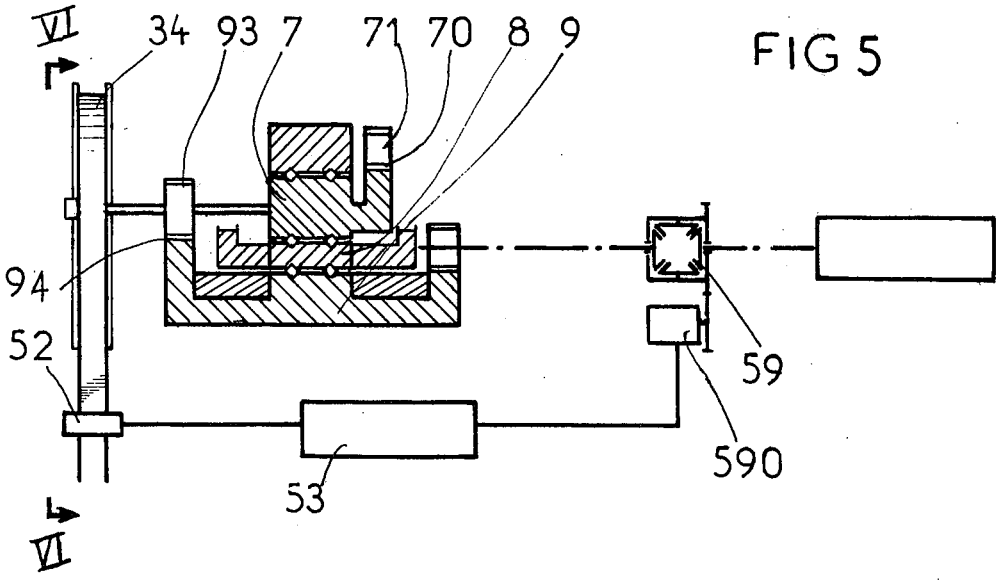
FIG. 5 is a diagrammatic view of part of the apparatus of FIG. 3.
Figure 6:
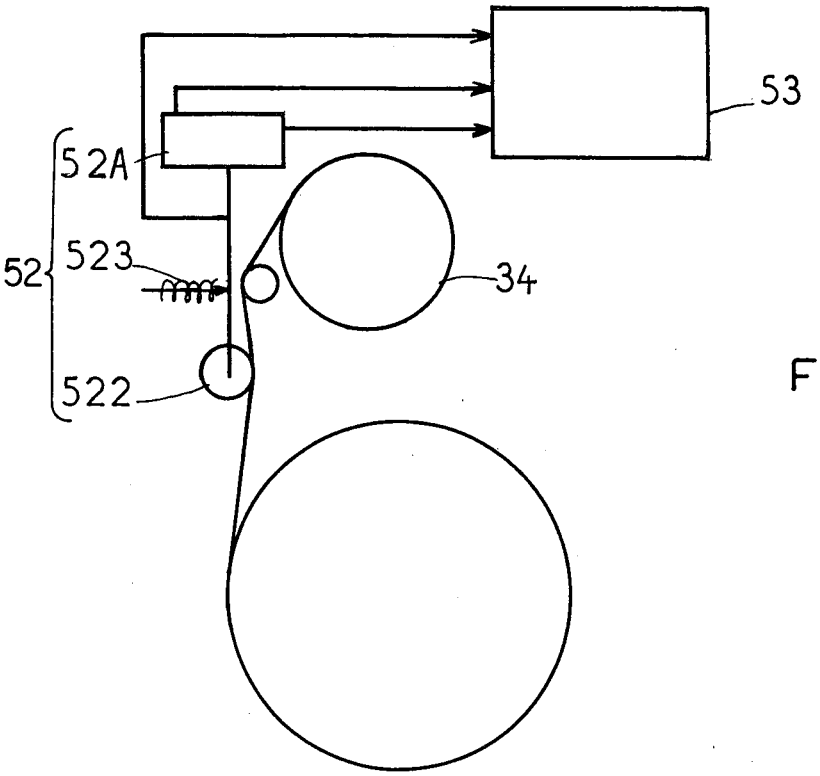
FIG. 6 is a detailed view taken on the line VI—VI in FIG. 5.

One of the tension sensors 52 is shown diagrammatically in FIG. 4*b*, and in more detail in FIGS. 5 and 6. It comprises a sensing element 52A for sensing the tension in the ribbon which transmits its data to regulator 53 via a brush 520 rubbing on a slip-ring 521 attached to the ring 60. The regulator 53 controls the secondary motor 590 to control the speed of unwinding the spool so as to keep the tension in the ribbon constant.

For improved clarity, FIG. 5 shows the spool 34 separately with its axle fixed on the turret 7 attached to the toothed ring 70 which is rotated by the pinion 71, and the ring 9 controlling the unwinding of the spool via the toothed ring 94 meshing with the pinion 93 keyed to the axle of the spool 34. The sensor 52 for sensing the tension in the ribbon is shown diagrammatically and by way of example only in FIG. 6, and comprises a roller 522 mounted at the end of a lever pivoted on the ring 7 and urged into contact with the ribbon unwinding from the spool 33 by a spring 523. The arm carrying the roller 522 controls the tension sensing element 52A which may, for example, consist of a potentiometer of known type as shown, for example, in U.S. Pat. No. 3,572,596 or a capacitive device. Data is transmitted from the tension sensing 52A via the brush 520 rubbing on the slip-ring 521 to the conventional regulator 53. The regulator then corrects the speed at which the spool 33 unwinds by controlling the speed of the secondary motor 590 which controls the differential 59, in order to reduce the error between the actual tension in the ribbon and the theoretical tension.

The machine also includes subsidiary features for achieving good windings of the strips. Thus, as described in U.S. Pat. application No. 75 31448, the axles of the spools have a variable inclination relative to the axis of the conduit so as to take account of the pitch of the strip wound on the conduit to ensure the strip is well applied, especially if it is a ribbon or wire of flattened section.

Furthermore, the pinion 40 controlling the advance of the machine is disengageable by means of a clutch and the frame 6 is fitted with a clamp 63 which can clamp the machine to the conduit so that it moves with it when, after the binding is complete, a new section is attached and the conduit advances by the length of a section. The machine is thus in the initial position for winding the ribbon on to the new section.

It will be understood that the invention and the machine which has just been described can be modified in various ways within the scope of the invention, particularly by the use of equivalent means.

Thus the advance of the winding machine along the conduit may be achieved by any suitable means, and, since the movement is relative, a fixed machine could be used and the conduit advanced.

Also, as has been mentioned, the wires could be would on in superposed layers to form bindings spaced along the length of the conduit.

What is claimed is:

1. Apparatus for winding at least two strips of an elongated product under tension onto a cylindrical body each from a spool holding a supply of product, said apparatus comprising, a frame displaceable longitudinally along the cylindrical body, a ring fixed to said frame and coaxially surrounding the cylindrical body, a first support turret supporting said spools, each spool being rotatably mounted on said turret around a respective fixed axis on said turret, second and third control turrets for controlling the unwinding of each respective spool, said second and third turrets each including a gear toothing, a pinion drivingly coupled with each spool and in mesh with the gear toothing of a respective one of the control turrets, roller bearing means rollably supporting the turrets on said ring for relative rolling movement around the cylindrical body, a main drive motor means for driving each individual turret around the cylindrical body, a differential drivingly coupling said main drive motor means and each said control turret, said differential including pinion gears, and auxiliary motor means for independently driving the pinion gears of said differential to control the tension of the strip.

2. Apparatus as claimed in claim 1 wherein said first, second and third turrets have different diameters, said roller bearing means comprising roller bearings between said ring and the assembly of turrets and between respective turrets.

3. Apparatus as claimed in claim 1 comprising means for sensing tension in each strip wound off the respective spool, and regulator means coupled to the tension sensing means for sending signals therefrom to said auxiliary motor means to control the unwinding after comparison of the measured tension with a pre-set tension.

* * * * *